US007578463B2

(12) United States Patent
Sotsky

(10) Patent No.: US 7,578,463 B2
(45) Date of Patent: Aug. 25, 2009

(54) MODULAR ROTARY GRINDER

(76) Inventor: George R. Sotsky, 3805 Wilderness Trail, Louisville, KY (US) 40299

( * ) Notice: Subject to any disclaimer, the term of this patent is extended or adjusted under 35 U.S.C. 154(b) by 147 days.

(21) Appl. No.: 11/685,562

(22) Filed: Mar. 13, 2007

(65) Prior Publication Data

US 2008/0283647 A1 Nov. 20, 2008

(51) Int. Cl.
*B02C 18/16* (2006.01)

(52) U.S. Cl. ..... 241/224; 241/242; 241/285.2; 241/285.3

(58) Field of Classification Search ..... 241/285.1, 241/285.2, 285.3, 222, 223, 224, 242
See application file for complete search history.

(56) References Cited

U.S. PATENT DOCUMENTS

| | | | | |
|---|---|---|---|---|
| 1,301,964 | A | 4/1919 | Overbury | |
| 1,567,920 | A | 12/1925 | Cumfer | |
| 1,874,902 | A | 8/1932 | Clyne | |
| 2,539,775 | A * | 1/1951 | Gordon | 241/188.2 |
| 2,655,213 | A | 10/1953 | Anderson | |
| 2,812,815 | A | 11/1957 | Quinsey et al. | |
| 3,143,016 | A | 8/1964 | Obenshain | |
| 3,186,277 | A | 6/1965 | Brunner | |
| 3,426,674 | A | 2/1969 | Testolin | |
| 3,756,519 | A * | 9/1973 | Reynolds et al. | 241/73 |
| 3,760,673 | A | 9/1973 | Peterson, Jr. | |
| 3,813,045 | A * | 5/1974 | Greiffenstern | 241/88.4 |
| 4,043,514 | A * | 8/1977 | Peterson, Jr. | 241/36 |
| 4,261,523 | A * | 4/1981 | LaPointe | 241/224 |
| 4,590,978 | A | 5/1986 | Kintz et al. | |
| 5,036,757 | A * | 8/1991 | Mueller | 99/519 |
| 5,150,844 | A | 9/1992 | McKie | |
| 5,273,218 | A | 12/1993 | Burns | |
| 5,320,292 | A | 6/1994 | Smith | |
| 5,320,293 | A | 6/1994 | Laly et al. | |
| 5,402,948 | A | 4/1995 | Kaczmarek | |
| 5,474,239 | A | 12/1995 | Williams, Jr. et al. | |
| 5,544,826 | A | 8/1996 | Klingler et al. | |
| 5,553,797 | A * | 9/1996 | Axelsson et al. | 241/285.3 |
| 5,695,137 | A | 12/1997 | Williams | |
| 5,711,492 | A | 1/1998 | Cheladze | |
| 5,947,395 | A | 9/1999 | Peterson et al. | |
| 5,971,305 | A | 10/1999 | Davenport | |
| 5,988,544 | A | 11/1999 | Williams, Jr. | |
| 6,305,623 | B1 | 10/2001 | Sotsky et al. | |
| 6,308,905 | B1 | 10/2001 | Balvanz et al. | |
| 3,694,378 | A1 | 5/2002 | Ragnarsson | |
| 6,422,495 | B1 | 7/2002 | De Boef et al. | |

* cited by examiner

*Primary Examiner*—Mark Rosenbaum
(74) *Attorney, Agent, or Firm*—James Cole; Middleton Reutlinger

(57) ABSTRACT

The present invention relates to a single shaft rotary grinder having a modular and/or split apart configuration. The modular configuration has assembly units and/or component parts that are interchangeable providing ease of construction of a rotary grinder having desired functionality for a specific application and/or providing ease of maintenance with the ability to replace worn or broken assembly units or component parts. The split apart configuration provides for the separation of a rear power head assembly and a front feeder assembly allowing easy access to the rotor and rear inner portion of the feed assembly.

20 Claims, 10 Drawing Sheets

MODULAR ROTARY GRINDER

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "SEQUENTIAL LISTING," A TABLE, OR A COMPUTER PROGRAM LISTING APPENDIX SUBMITTED ON A COMPACT DISC

Not applicable.

BACKGROUND OF THE INVENTION

1. Field of the Invention

The present invention relates to a rotary grinder with an improved modular and/or split apart design.

2. Description of the Related Art

Rotary grinders with forced horizontal feed are known. Typically, they are designed to have a ram compartment with a lower compartment plate serving as a lower portion of a hopper of the grinder. A reciprocating ram, typically horizontally driven by a hydraulic piston system, has a vertically situated ram slidingly resting on the horizontally situated lower compartment plate and forces material from the hopper to a rear power head having a rotor with teeth for reducing the material in the hopper. Other feed systems such as roller feeder systems have been used wherein the material is fed to the rotor between a pair of opposing rollers.

Typically, the rotary grinders of the prior art are of a unitary structure wherein sidewalls of the grinder extend from the front compartment to the rear power head. Such a configuration makes it difficult or impossible to custom assemble a rotary grinder having a selected front compartment with a selected rear power head or to change the configuration of the rotary grinder once having been manufactured. Additionally, these unitary rotary grinders have lacked modular components and assemblies that can be replaced with the same or different components for maintenance or reconfiguration of the rotary grinder. Furthermore, the unitary configuration of the prior art rotary grinders makes it difficult to access parts and components for maintenance, repair, or replacement such as replacing teeth on the rotor or adjusting a counter knife.

SUMMARY OF THE INVENTION

Rotary grinders of embodiments of the present invention are, for example, used to grind plastic, carpet, wood or other solid materials to reduce the size of the material to a desired size. The rotary grinder may also be used to reduce material such as film, fibrous material and other materials which have a tendency to wrap around the rotor. The materials to be shredded are placed into a hopper or other feeding mechanism such as opposed cylindrical rollers. In an embodiment having a hopper, a reciprocating ram is used to drive the material toward a counter knife horizontally situated with the longitudinal axis of the rotor. The rotor has a plurality of cutters removably mounted thereon. When in use, the ram travels from its open position near the front end of the rotary grinder across the hopper floor or lower compartment plate towards the rotor, pushing material towards the rotor and counter knife. As the rotor revolves about its axial shaft, the cutters on the rotor engage the material in the hopper drawing the material downward towards the counter knife. The counter knife has a cutting edge with interstices that closely receive the cutters on the rotor. The material is cut into pieces between the cutters and the counter knife.

Embodiments of the present invention for a rotary grinder have an improved modular and/or split apart configuration. The modular configuration has a separate front compartment assembly and rear power head assembly. The front compartment assembly has modular components such as a ram assembly, component sidewalls, and a support frame assembly. Other optional components include a hydraulic system for separating the front compartment assembly from the rear power head assembly and electronic sensors and control component assemblies. The rear power head assembly has modular components such as a rear power head frame supporting a modular right and left power head wall, an anvil, a rotor, a gear box, and a motor. Each of these component parts may have subcomponents and may be removed and replaced with the same or different component, subcomponent, or assembly making the modular rotary grinder transformable for different grinding needs or serviceable by the replacement of component parts.

In a split apart configuration, a front compartment assembly has a front compartment and a ram assembly where the front compartment is defined by a lower compartment plate and upward extending compartment sidewalls proximate each longitudinal edge of the lower compartment plate. The compartment plate and sidewalls are supported with a modularized front compartment frame. A ram assembly has a vertically oriented ram with a lower edge proximate the horizontally situated compartment plate and side edges proximate each sidewall. Each compartment sidewall has a front mating edge for engagement with rear mating edges on sidewalls of a rear power head assembly. An anvil extends between the lower end of the rear mating edges of the power head assembly sidewalls and is engageable with the lower compartment plate. Engagement of the mating edges and the anvil with the lower compartment plate forms a compartment having a rotor in a rear portion thereof and disengagement of the mating edges and anvil from the lower compartment plate provides for working space between the rear power head assembly and the front compartment assembly. A retainer assembly has a portion on the front compartment assembly and a portion on the rear power head assembly for removably retaining the front compartment assembly with the rear power head assembly.

The front compartment can be slidingly engageable with the rear power head assembly or the front compartment may be hingedly cooperable at a front of the compartment plate enabling the rear of the compartment plate to swing upwardly providing a working space between the rear power head assembly and the front compartment assembly.

BRIEF DESCRIPTION OF THE DRAWINGS

A better understanding of the invention will be had upon reference to the following description in conjunction with the accompanying drawings wherein:

FIG. 3A is a cut-away view of the modular rotary grinder of FIG. 3 showing the front compartment assembly end of a retainer assembly;

FIG. 4A is a cut-away view of the modular rotary grinder of FIG. 4 showing the rear power head assembly end of a retainer assembly;

FIG. 5A is a cut-away from FIG. 5 showing the components of a grinder control system;

FIG. 7A is a cut-away from FIG. 7 showing a portion of a retainer assembly;

DETAILED DESCRIPTION

While this invention is susceptible of embodiments in many different forms, there are shown in the Figures and will herein be described in detail, embodiments of the invention with the understanding that the present disclosure is to be considered as an exemplification of the principles of the invention, and is not intended to limit the broad aspects of the invention to the embodiments illustrated.

Figure 1:
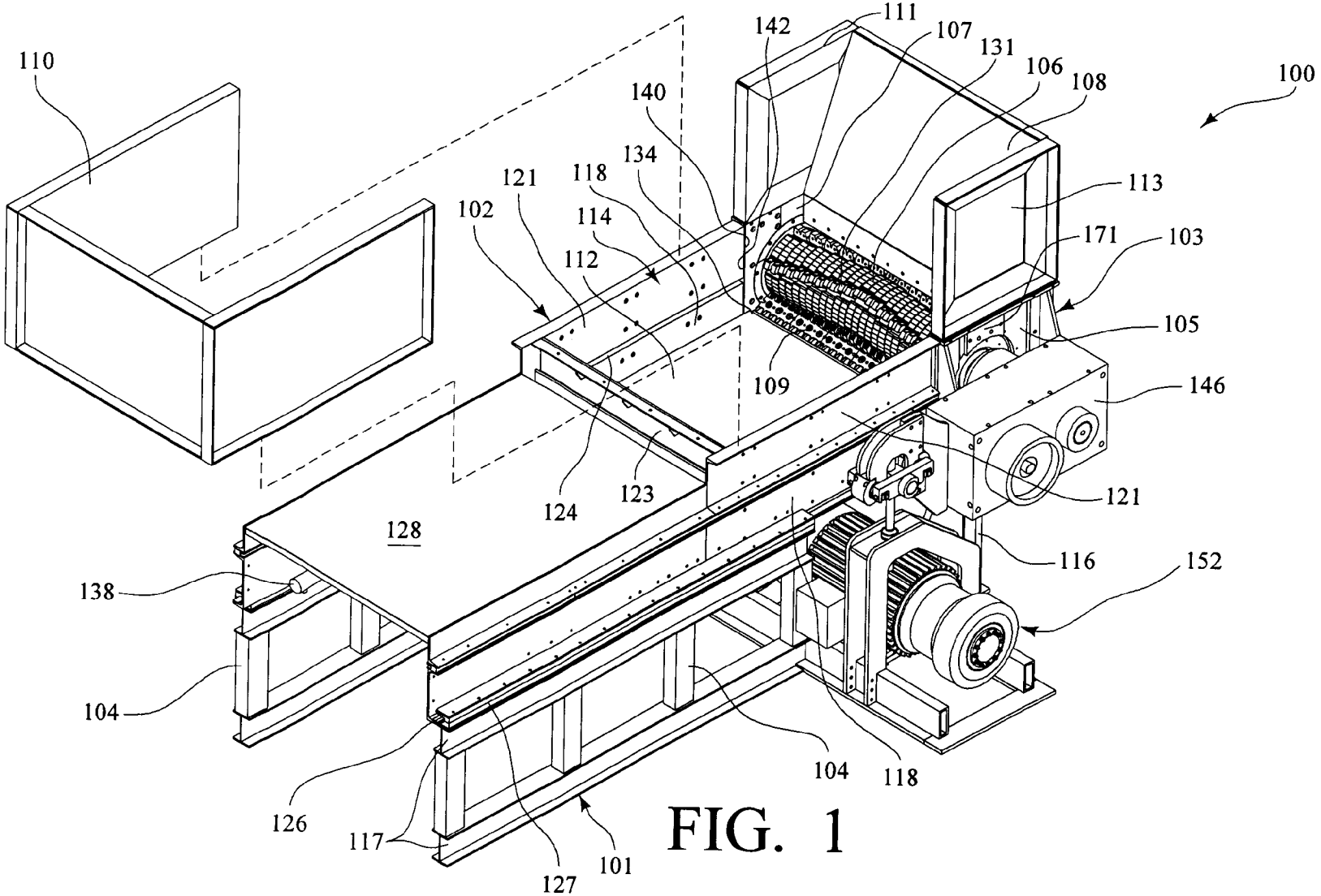
FIG. 1 is a perspective view of a modular rotary grinder having a slide apart design showing a rear power assembly and a front compartment assembly having a hopper partially removed and a ram in retracted position.

With reference to FIG. 1, modular single shaft rotary grinder 100 is shown having a rear power head assembly 103 and front compartment assembly 102 matingly engaged. Rear power head assembly 103 comprises power head frame 116 supporting modular component parts of power head assembly 103. Component parts of power head assembly 103 include motor 152 attached to a lower part of housing assembly 116 and in mechanical cooperation with gear box 146. Gear box 146 is also in mechanical cooperation with rotor 106 and transfers power from motor 152 to rotor 106. Right lower power head wall 105 and left lower power head wall 107 each have an aperture for receiving an axial end of rotor 106. In this embodiment, right and left power head walls 105 and 107 have a vertical opening above the axial ends of rotor covered with plate 171. Plate 171 is removable permitting the vertical removal of rotor 106 with left and right power head walls 105 and 107 attached to power head frame 116. Right power head walls 105 and 107 have a rear mating edge 142. Moveable anvil 136 (shown in FIG. 3A) movably extends between right and left lower power head walls 105 and 107 proximate a front lower portion of rotor 106. Counter knife 109 moveably attaches to a top surface of anvil 136 and has a contoured blade adjacent rotor 106 closely receiving cutters 131 removably extending from an outer cylindrical surface of rotor 106 as rotor 106 rotates. Upper rear wall 108 is joined with and situated between upper right wall 113 and upper left wall 111 forming a rear portion of a hopper. Upper rear wall 108 is shown in this embodiment as sloping, but may be vertical.

Front compartment assembly 102 has front compartment 114 and a ram assembly (115, FIG. 5) supported by modular front compartment frame 101 having a plurality of compartment supporting legs 104 extending between two longitudinally extending supporting beams. Front compartment 114 is defined by lower compartment plate 112 and an upward extending lower sidewall 118 proximate each longitudinal edge of lower compartment plate 112. Lower compartment plate 112 has compartment plate lip 134 extending over movable anvil 136. Lower sidewalls 118 each have a front mating edge 140. Atop a rear modular section of each lower sidewall 118 extends an upper side wall 121. Upper hopper assembly 110 is shown removed from upper sidewall 121. When upper hopper assembly 110 is removably fastened to upper sidewalls 121, a hopper is formed extending over front compartment plate 112 and rotor 106. Upper right wall 113, upper left wall 111, and upper rear wall 108 form a rear section of the hopper over the rotor. Ram assembly 115 is covered with compartment top cover 128 and ram 119 (shown in FIG. 5) has compartment rear wall 123 extending upward therefrom when ram 119 is in a retracted position as is shown in FIG. 1. Ram slide rail 124 longitudinally extends between each lower side wall 118 and upper sidewall 121 wherein an outwardly depending portion of ram 119 slides when ram 119 is longitudinally pushed or pulled to or from rear power head assembly 103 with a ram hydraulic system having ram hydraulic cylinder 138. Preferably ram slide rails 124 have a polymeric lining reducing friction within ram assembly 115. Lower side walls 118 modularly extend to the front of front compartment assembly 102 and have an outwardly extending flange 126 slidingly engaging compartment slide rails 127. Outwardly extending flanges 126 and compartment slide rails 127 enable front compartment assembly 102 to be slidingly separated from rear power head assembly 103. Preferably, the power to slide front compartment assembly 102 to and from rear power head assembly 103 is hydraulically supplied by an independent hydraulic system.

Figure 2:
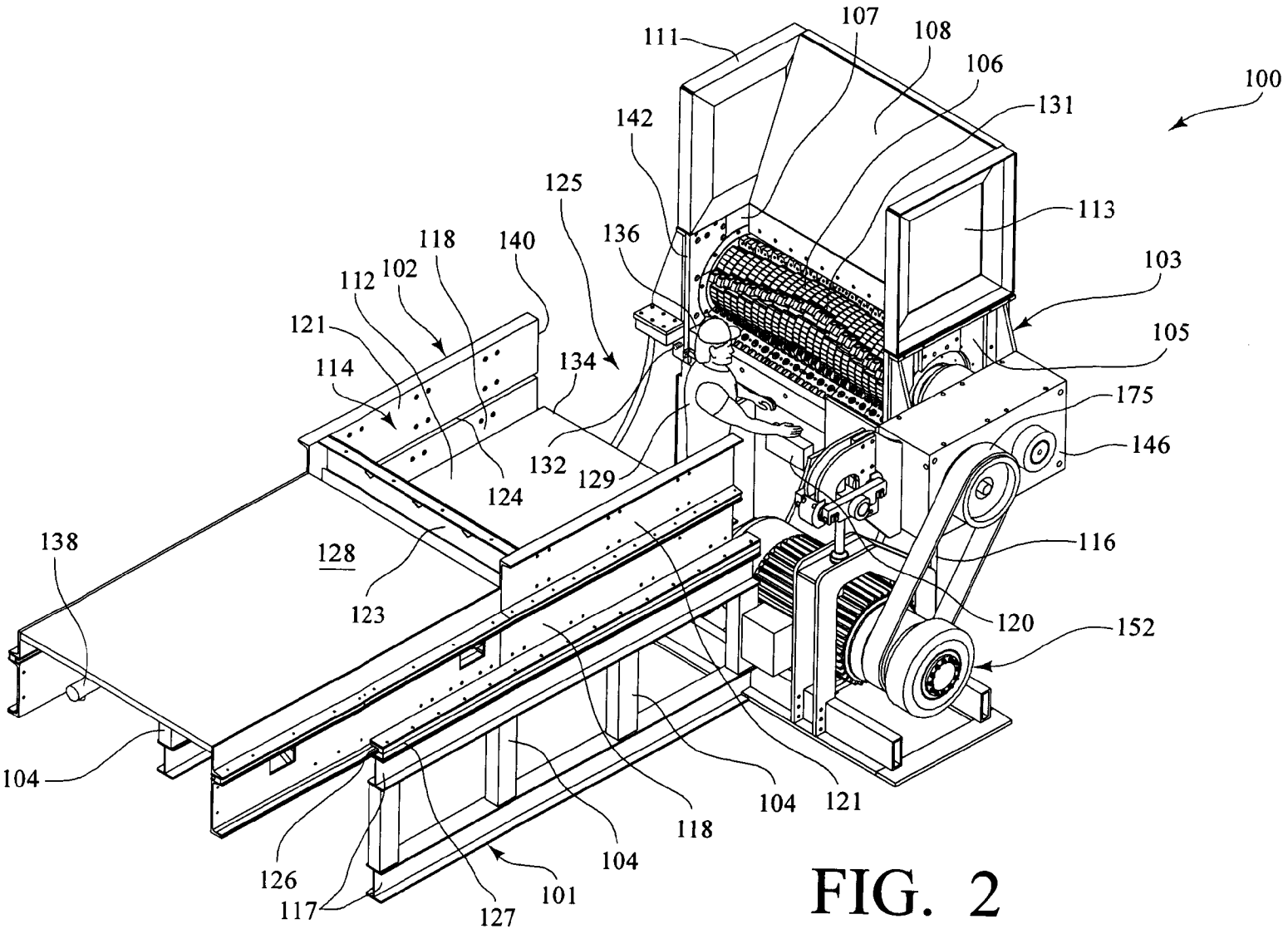
FIG. 2 is a perspective view of the modular rotary grinder of FIG. 1 having the front compartment assembly slid apart from the rear power assembly.

With reference to FIG. 2, single shaft rotary grinder 100 is shown having a rear power head assembly 103 and front compartment assembly 102 in a split apart configuration. Rear power head assembly 103 comprises power head frame 116 supporting component parts of power head assembly 103. Front compartment assembly 102 has front compartment 114 and a ram assembly 115 (FIG. 5) supported by modular front compartment frame 101. In this split apart configuration, worker 129 is availed space to enter between front compartment assembly 102 and rear power head assembly 103 to perform maintenance operations without the need to empty front compartment 114 of materials being ground. In this embodiment, front compartment assembly 102 slides apart from rear power head assembly 103 on modular front compartment frame 101. The slide apart feature is provided with lower outwardly extending flange 126 extending outwardly from each lower longitudinal edge of front compartment assembly 102 slidingly engaging a compartment slide rail 127. Preferably, surfaces of compartment slide rail 127 slidingly engaging flanges 126 are comprised of a polymeric material reducing the friction between front compartment assembly 102 and modular front compartment frame 101 when sliding front compartment assembly fore and aft of modular front compartment frame 101. In this slide or split apart configuration, rear mating edges 142 and front mating edges 140 are separated and compartment plate lip 134 is removed from a top surface of anvil 136. Cylindrical hydraulic ram 138 provides the force necessary to slide front compartment assembly 102 fore and aft of modular front compartment frame 101.

In the split apart configuration as shown in FIG. 2, worker 129 has easy access to modular components of power head assembly 103 and compartment assembly 102 for maintenance and/or replacement. For instance, rotor 106 may be cleared of debris, cutters on rotor 106 may be serviced or replaced, anvil 136 may be adjusted, and counter knife 109 may be replaced, serviced, or adjusted without the need to clear front compartment 114 of debris or disassemble portions of rotary grinder 100 to gain access to component parts. Additionally, access to modular parts such as motor 152 and gear box 146 is increased. In this view, removable belt 175 is shown cooperating with motor 152 and gear box 146 wherein motor 152 and gear box 146 are mounted to power head frame 103 in a parallel configuration. However, it is to be understood that motor 152 and gear box 146 may be in a right angle mount, have a fluid coupling and/or have a controlled torque coupling. The optional fluid coupling provides for a soft start while the controlled torque coupling protects against over torque as may be experienced with a rotor lock.

Figure 3:
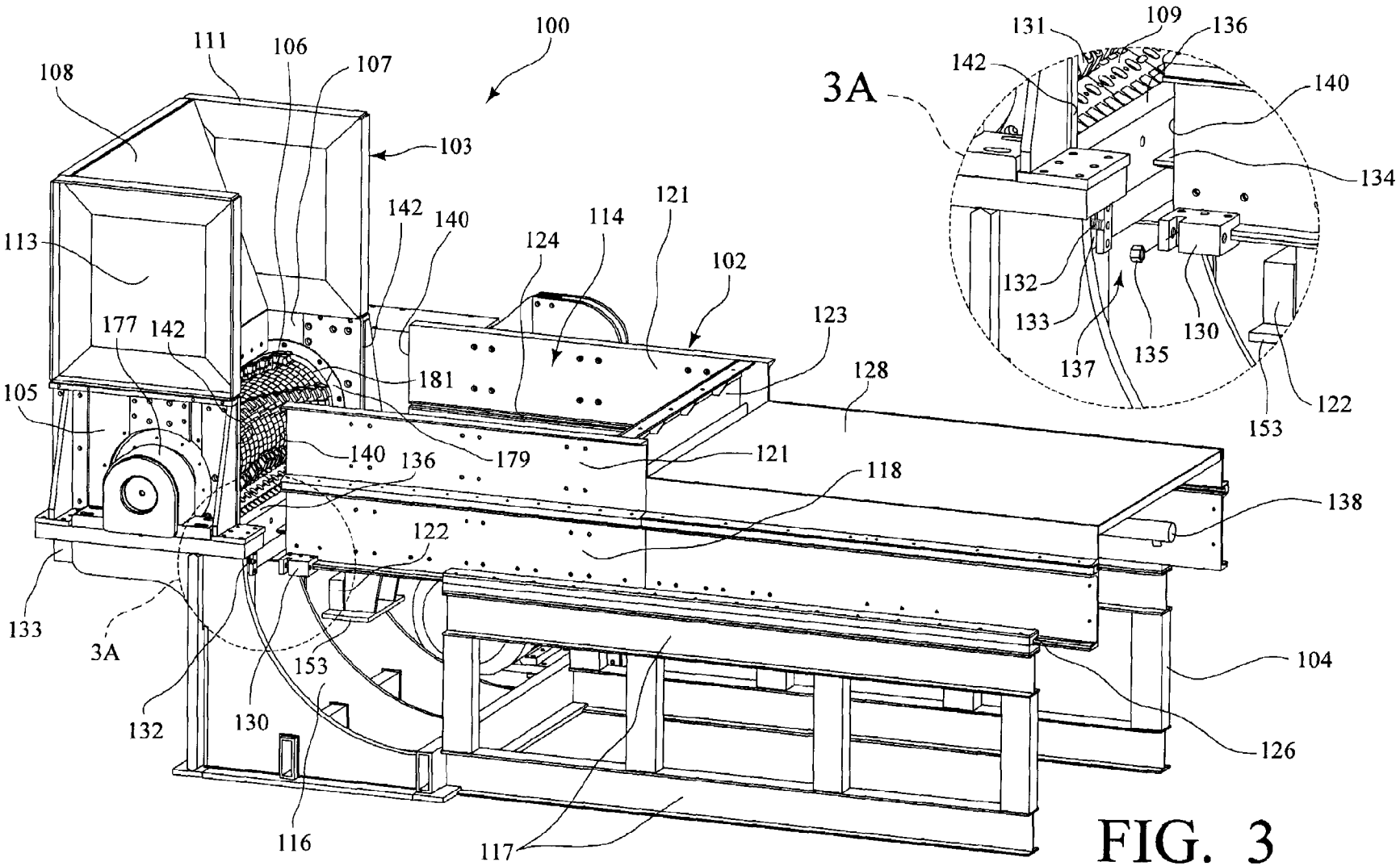
FIG. 3 is a perspective view of the modular rotary grinder of FIG. 1 having the front compartment assembly slid apart from the power assembly showing a compartment assembly end of a retainer assembly for removably retaining the front compartment assembly to the rear power assembly.

FIG. 3 shows modular rotary grinder 100 in a split apart configuration with a retainer assembly shown in detail in FIG. 3A. Rotary grinder 100 comprises rear power head assembly 103 having a power head frame 116 supporting a right lower power head wall 105, a left lower power head wall 107, an anvil 136, a rotor 106, a gear box 146 (shown in FIG. 1), and a motor 152 (shown in FIG. 1). Right lower power head wall 105 and left lower power head wall 107 each extend upward from power head frame 116 about each axial end of rotor 106 and have a rear mating edge 142, anvil 136 movably extends between right and left lower power head walls 105 and 107 proximate a front lower portion of rotor 106 and has counter knife 109 moveably engaged on an upper surface thereof. Counter knife 109 may be adjusted closer to rotor 106 maintaining a close tolerance between cutters 131 and a cutting edge on counter knife 109. Additionally, in the embodiment shown, counter knife 109 may be serviced or removed, rotated, and reinstalled onto anvil 136 placing an opposite cutting edge of counter knife 109 adjacent cutters 131. This can be accomplished manually in the split apart configuration without the need to enter the hopper or compartment 114.

Front compartment assembly 102 having front compartment 114 and ram assembly 115 where front compartment 114 is defined by lower compartment plate 112 and an upward extending lower compartment sidewall 118 proximate each longitudinal edge of lower compartment plate 112. Front compartment assembly 102 is supported with a front compartment frame having supporting beams 117 interposed with supporting legs 104. Lower compartment sidewalls 118 each have a front mating edge 140 that matingly engage a rear mating edge 142 on rear power head assembly 103. Anvil 136 and lower compartment plate 112 are shown as being slidingly disengaged. Engagement of mating edges 140 and 142 and anvil 136 with lower compartment plate 112 forms compartment 114 having rotor 106 in a rear portion thereof and sliding disengagement of mating edges 140 and 142 and disengagement of anvil 136 from lower compartment plate lip 134 provides for working space between rear power head assembly 103 and front compartment assembly 102. A retainer assembly 137 is shown in FIG. 3A has a portion on front compartment assembly 102 and a portion on rear power head assembly 103. Each portion of the retainer assembly 137 is cooperable with the other portion enabling front compartment assembly 102 and rear power head assembly 103 to be securely engaged wherein front and front mating edges 142 and 140 are mated and anvil 136 is mated with compartment plate 112. The portion of the retainer assembly 137 on front compartment assembly 102 may be a clamp rod sleeve 133 or a clamp rod fastener retainer 130 on an upper portion of each side of power head frame assembly 116 where front compartment assembly 102 has the other of clamp rod sleeve 133 or clamp rod fastener retainer 130 proximate each rear outer corner of compartment plate 112. Clamp rod 132 extends through clamp rod sleeve 133 into clamp rod fastener retainer 130 and removably cooperates with fastener 135 removably retained in fastener retainer 130. In the embodiment shown here, clamp rod 132 is a threaded bolt and fastener 135 is a nut threadingly engageable with threaded bolt 132. Fastener retainer 130 may have a threaded portion therein eliminating the need for threaded bolt 132. Also shown in FIG. 3A is compartment bumper plate 122 centrally depending from a lower side of compartment plate 112 which engages power head bumper plate 120 (shown in FIG. 5) centrally oriented on a front portion of power head frame 116. Compartment bumper plate 122 engages power head bumper plate 120 when retainer assembly 137 securely engaged. Shown in FIG. 3 is optional horizontal plate 153 outwardly extending under bumper plate 122 wherein a top surface engages a lower surface of power head bumper plate 120 or other vertically supporting member on power head frame 116. Also shown here is outer fixed seal ring 179 and inner rotating seal ring 181 having a close tolerance therebetween. Having inner rotating seal ring 181 with a larger diameter than rotor 106 substantially decreases or even eliminates materials being ground from lodging between axial ends of rotor 106 and sidewalls 105 and 107. Pillow block bearing 177 is shown supporting an axial end of rotor 106 on power head frame 116, however, any bearing or other friction reducing engaging means as is known in the art may support axial ends of rotor 106. Preferably, pillow block bearing 177 is horizontally separable wherein a top portion can be removed allowing rotor 106 to be vertically removed.

Figure 4:
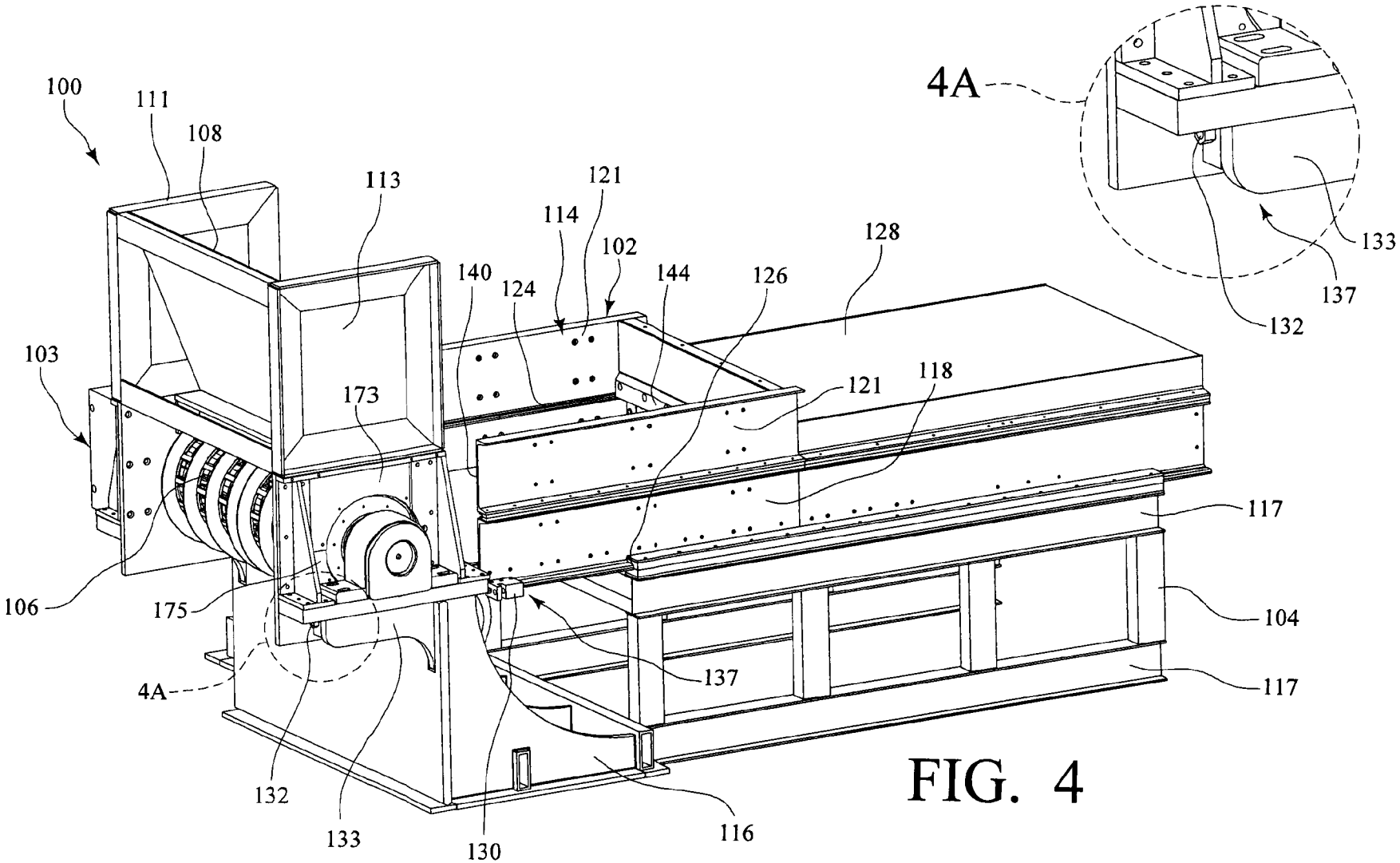
FIG. 4 is a perspective view of the modular rotary grinder of FIG. 1 having the front compartment assembly slid apart from the power assembly showing a rear power head end of a retainer assembly for removably retaining the front compartment assembly to the rear power assembly.

FIGS. 4 and 4A show retainer assembly 137 having a portion on front compartment assembly 102 and a portion on rear power head assembly 103. The portion of the retainer assembly 137 on power head frame assembly 116 has clamp rod sleeve 133. Clamp rod 132 is in the form of a threaded bolt having the head of clamp rod 132 adjacent clamp rod sleeve 133.

It is important to note that the fastening combination of retainer assembly 137 may be in a reverse orientation and still provide the function of fastening front compartment assembly 102 with rear power assembly 103 joining front mating edges 140 with rear mating edges 142 and compartment bumper plate 122 with power head bumper plate 120. Additionally, other removable fastening combinations as is known in the art may be used to removably secure front compartment assembly 102 to rear power assembly 103. An alternative embodiment of a power head wall is shown here wherein right and/or left power head walls are modular having an upper power head wall component 173 and a lower power head wall component 175. The separation of upper power head wall component 173 and lower power head wall component 175 provides for the vertical removal of rotor 106.

Figure 5:
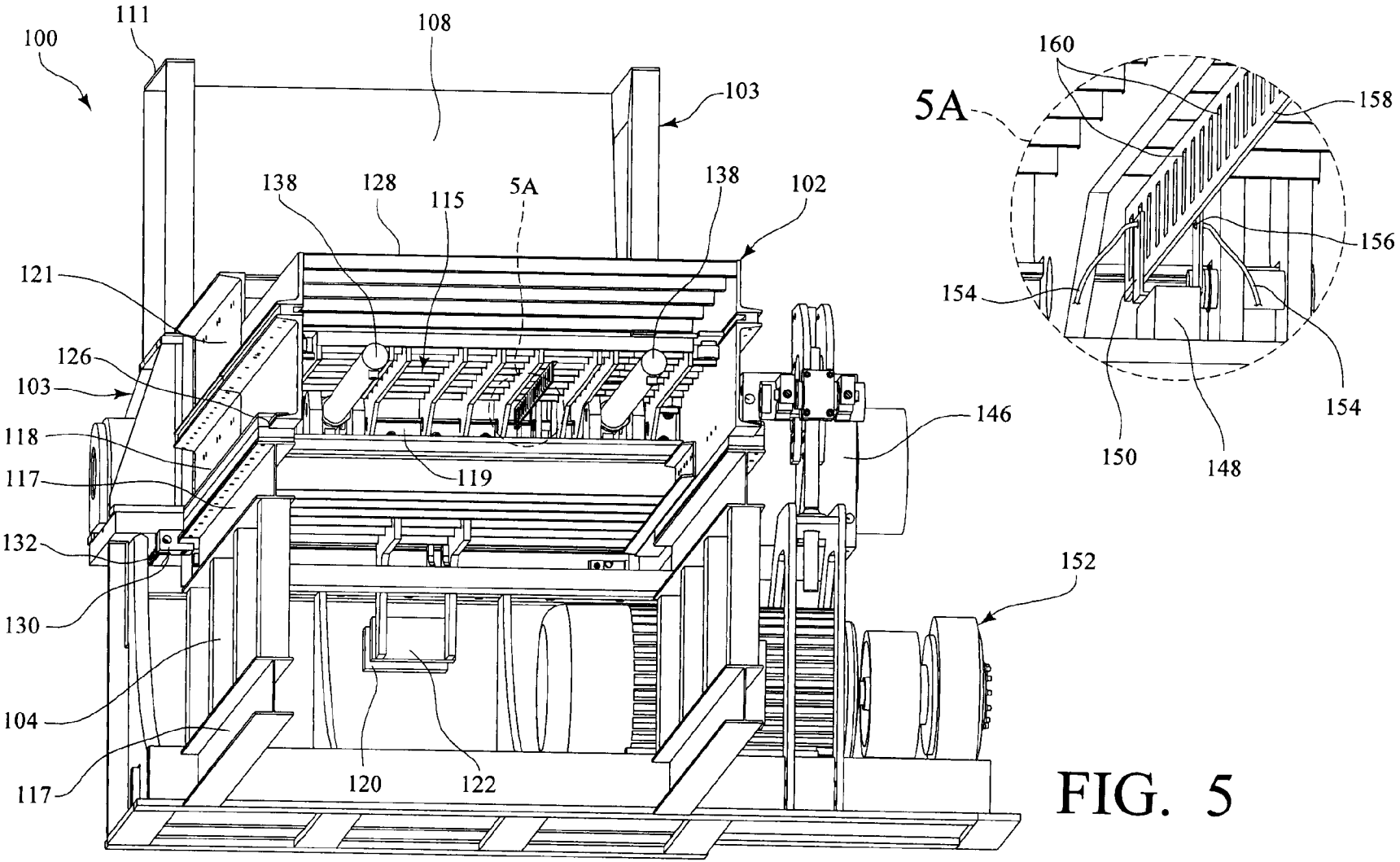
FIG. 5 is a rear lower perspective view showing the modular rotary grinder of FIG. 1.

FIG. 5 shows a bottom perspective view of modular grinder 100. In this view, rear power head bumper plate 120 is in an aligning relationship with front compartment bumper plate 122. When front compartment assembly 102 and rear power assembly 103 are in an engaged position with front mating edges 140 mated with rear mating edges 142, rear power head bumper plate 120 and front compartment bumper plate 122 become engaged. Therefore, rear power assembly 103 and front compartment assembly 102 are held together in a stable linear relationship with the central engagement of retainer assembly 137, upper engagement of front mating edges 140 with rear mating edges 142, and lower engagement of power head bumper plate 120 with front compartment bumper plate 122. Also shown in this figure and detailed in FIG. 5 A are components of an embodiment of a grinder control mechanism having a ram position sensor rail 158 with slots 160. Ram position sensor rail 158 is attached to ram assembly 115 having ram 119 on a rear end thereof and moves fore and aft of front compartment assembly 102 pushing materials toward rotor 106. Sensor 156 and ram position sensor rail bracket 150 are mounted atop ram position sensor mount 148 and senses the position of ram sensor rail 158 via slots 160 and sends a signal through cable 154 to an external electronic control system (not shown). Ram assembly 115 has ram 19 vertically oriented and extending between lower compartment sidewalls 118 and up from lower compartment plate 112. Ram sensor rail 158 is attached to ram assembly 115 and moves therewith, therefore ram sensor 156 senses the position of ram 119. Other embodiments of a grinder control mechanism include laser or sonar sensor mechanisms having limit, velocity, and position controls.

Figure 5B:
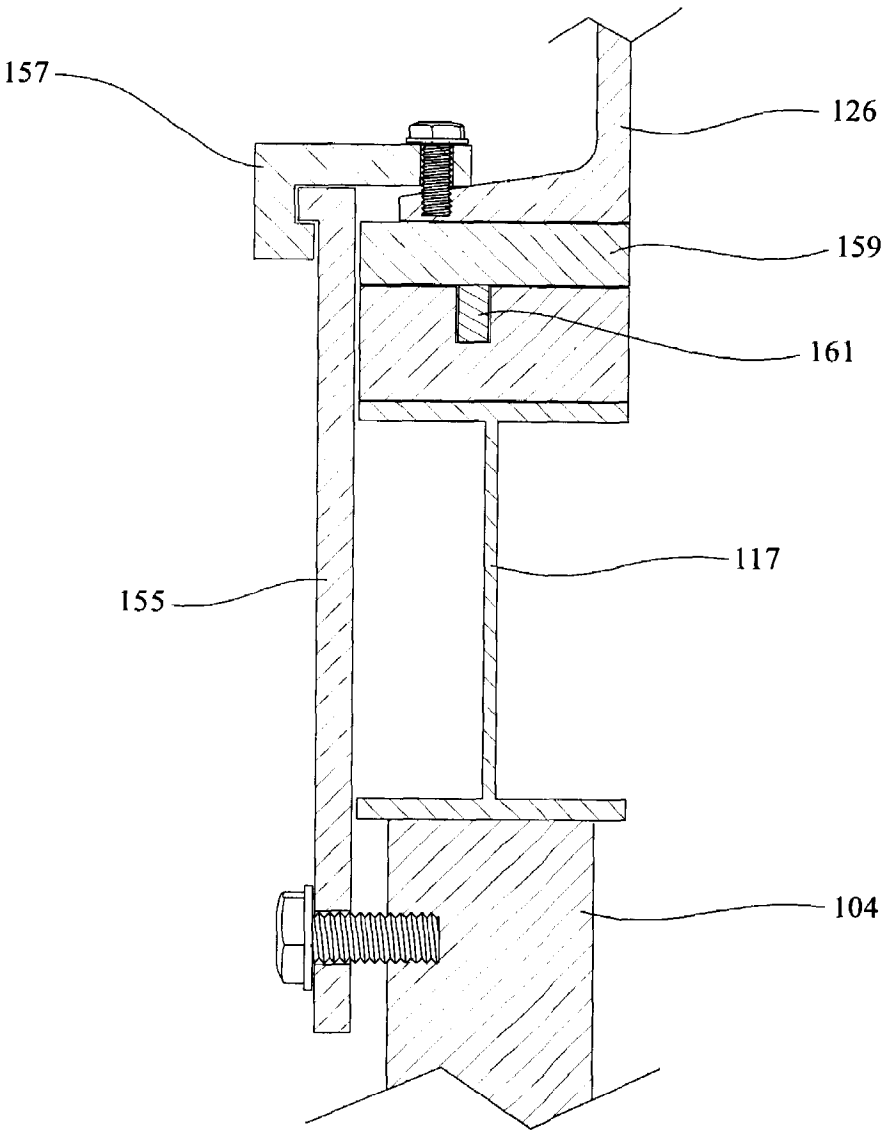
FIG. 5B is a rear lower cutaway view of a portion of the compartment assembly and frame showing an embodiment of a slidingly engagement therebetween.

FIG. 5B shows an alternative embodiment of elements for slidingly cooperation between front compartment assembly 102 and modular front compartment frame 101. Supporting leg 104 supports supporting beams 117. Supporting beams 117 support notched slide 162, preferably comprised of a polymeric material. Outwardly extending flange 126 has longitudinally extending upper slide 159 with longitudinally extending guide 161 attached to a lower surface thereof. Preferably, upper slide 159 and guide 161 are comprised of a metallic material slidingly engaging notched slide 162. Also shown here is an optional lateral support feature comprising guide 155 and guide retainer 157. Guide 155 longitudinally extends supporting beam 117 and has an outwardly extending upper end. Guide retainer 157 longitudinally extends and is attached to flange 126 and extends around guide 155 providing slidingly lateral support between front compartment assembly 102 and front compartment frame 101.

Figure 6:
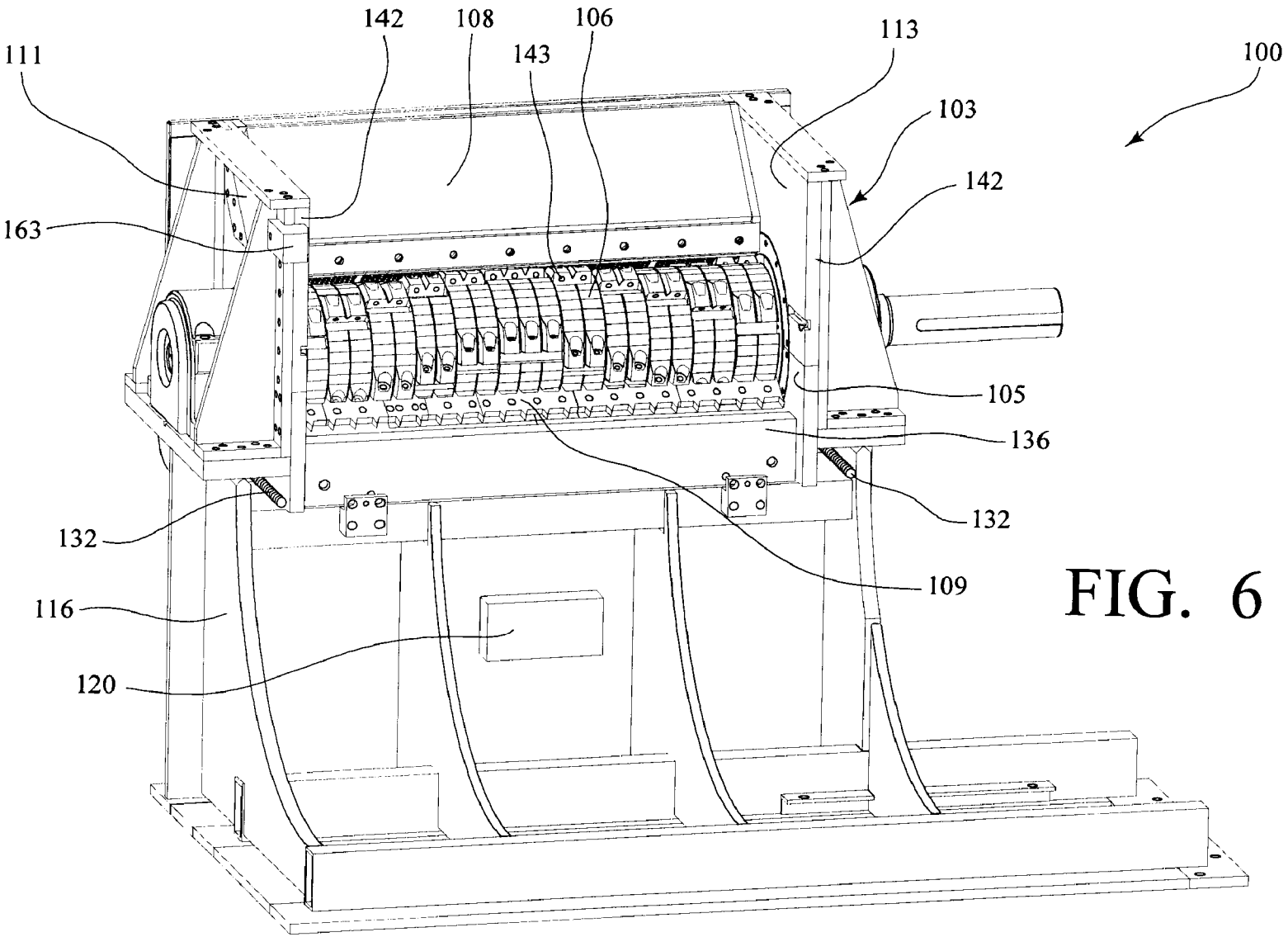
FIG. 6 is a perspective view of a rear power head assembly showing rear mating edges and a rear bumper plate.

FIG. 6 is a perspective view of rear power head assembly 600 showing rear mating edges 142 and power head bumper plate 120. Rear power head assembly 600 comprises power head frame 116 supporting modular component parts of power head assembly 600. Right lower power head wall 105 and left lower power head wall 107 are each about an axial end of rotor 106 and have a rear mating edge 142. Preferably, left and right lower power head walls 105 and 107 each have removable modular upper half or a slot in an upper half allowing for the vertical removal of rotor 106 without the removal of power head walls 105 and 107. Rotor 106 is shown here as having tool holders 143 extending from an outer cylindrical surface thereof for supporting cutters thereon. Moveable anvil 136 movably extends between right and left lower power head walls 105 and 107 proximate a front lower portion of rotor 106. Counter knife 109 moveably attaches to a top surface of anvil 136 and has a contoured blade adjacent rotor 106 closely receiving cutters attached to tool holders 143 as rotor 106 rotates. Upper rear wall 108 is joined between upper right wall 113 and upper left wall 111 forming a rear portion of a hopper. Upper rear wall 108 is shown in this embodiment as sloping, but may be vertical. Also shown here is optional guide block 163 extending from upper left power head wall 111 which engages an outer surface of upper side compartment wall 121 when front compartment assembly 102 engages rear power head assembly 103.

Figure 7:
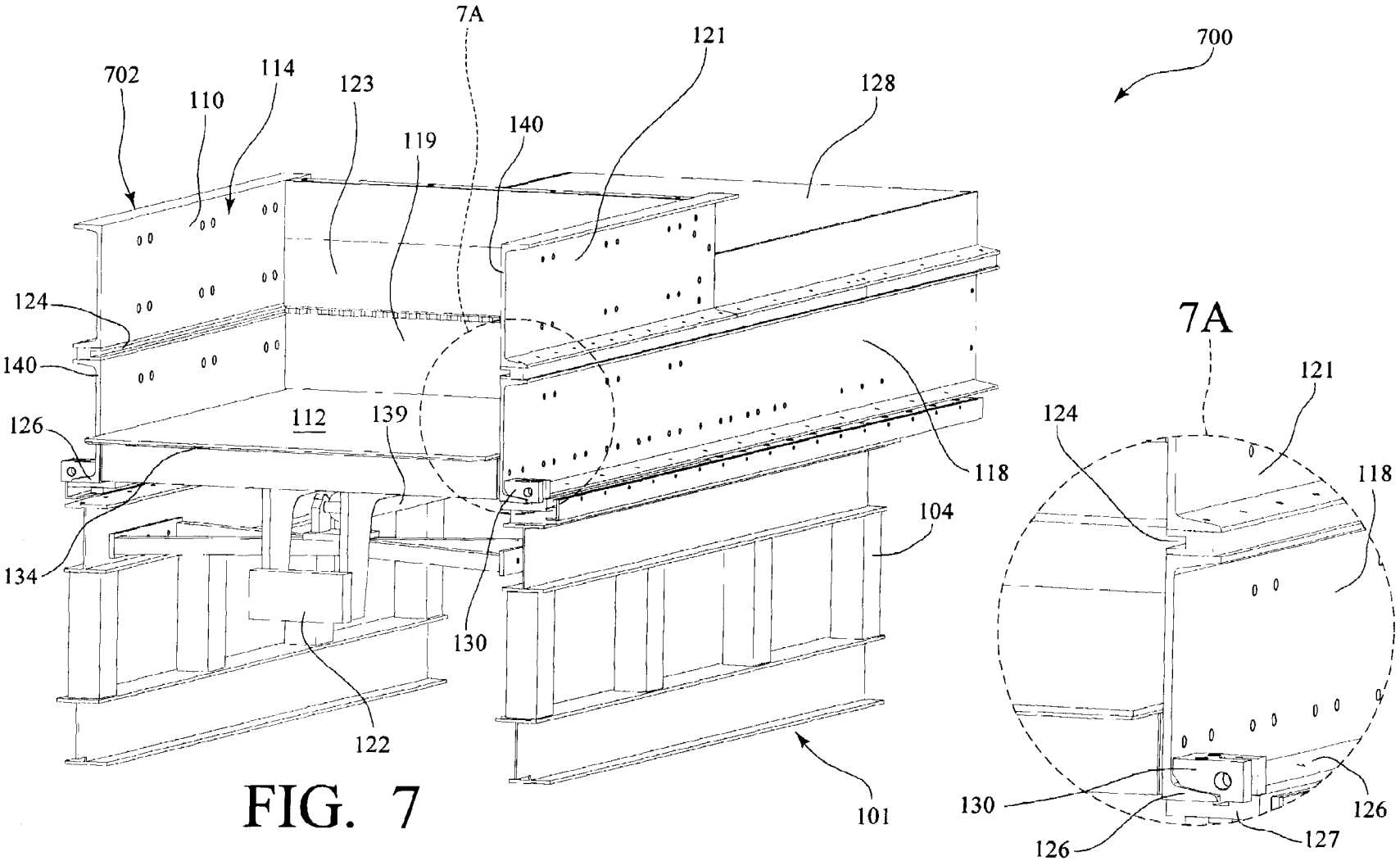
FIG. 7 is a perspective view of a front compartment assembly showing front mating edges and a front bumper plate.

FIG. 7 is a perspective view of a front compartment assembly 700 showing front mating edges 140 and front bumper plate 122. Front compartment assembly 102 has front compartment 114 and a ram 119 supported by modular front compartment frame 101 having a plurality of compartment supporting legs 104 extending between two longitudinally extending supporting beams. Front compartment 114 is defined by lower compartment plate 112 and an upward extending lower sidewall 118 proximate each longitudinal edge of lower compartment plate 112. Lower compartment plate 112 has compartment plate lip 134 extending beyond lower sidewalls 118. Lower sidewalls 118 each have a front mating edge 140. Atop a rear modular section of each lower sidewall 118 extends an upper side wall 121, also having front mating edge 140. FIG. 7A is a cut-away portion of the front compartment assembly 700 of FIG. 7 showing ram slide rail 124 longitudinally extending between each lower side wall 118 and upper sidewall 121 wherein an outwardly depending portion of ram 119 slides when ram 119 is longitudinally pushed or pulled to or from a rear power head assembly with a ram hydraulic system. Hydraulic cylinder 139 is a part of an embodiment of a separate hydraulic system for sliding front compartment assembly 102 on front compartment frame 101. Preferably ram slide rails 124 have a polymeric lining reducing friction within ram assembly 115. Lower side walls 118 have an outwardly extending flange 126 slidingly engaging compartment slide rails 127. Optionally, outwardly extending flange 126 is a removable component part of sidewall 118. Outwardly extending flanges 126 and compartment slide rails 127 enable front compartment assembly 702 to be slidingly separated from a rear power head assembly 103.

Figure 8:
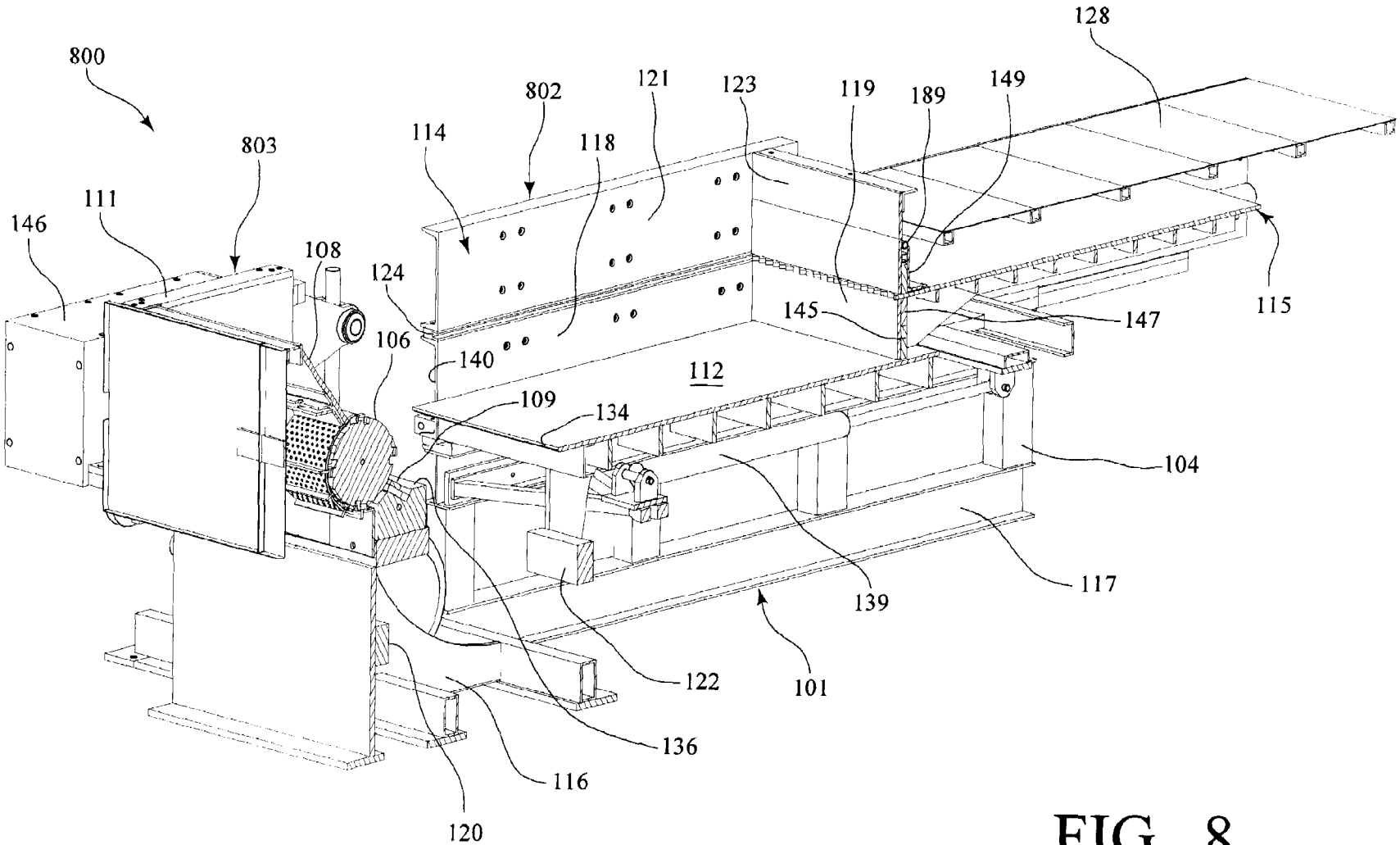
FIG. 8 is a cutaway perspective view of a rear power head assembly and a front compartment assembly showing internal components thereof.

FIG. 8 is a cutaway perspective view of a rear power head assembly and a front compartment assembly showing internal components thereof. Modular single shaft rotary grinder 800 is shown having a rear power head assembly 803 and front compartment assembly 802 in a split apart configuration. Rear power head assembly 803 comprises power head frame 116 having gear box 146 attached thereto. Gear box 146 is in mechanical cooperation with rotor 106 and transfers to rotor 106. Moveable anvil 136 movably extends between right and left lower power head walls proximate a front lower portion of rotor 106. Counter knife 109 moveably attaches to a top surface of anvil 136 and has a contoured blade adjacent rotor 106 closely receiving cutters depending from an outer cylindrical surface of rotor 106 as rotor 106 rotates. Upper left wall 111 and upper rear wall 108 form a rear portion of a hopper. Power head bumper plate 120 is shown centrally oriented within power frame 116.

Front compartment assembly 802 has front compartment 114 and ram assembly 115 supported by modular front compartment frame 101 having a plurality of compartment supporting legs 104 extending from longitudinally extending supporting beams 117. Front compartment 114 is defined by lower compartment plate 112 and an upward extending lower sidewall 118 proximate each longitudinal edge of lower compartment plate 112. Lower compartment plate 112 has compartment plate lip 134 which extends over movable anvil 136 when front compartment assembly 802 is mated with rear power assembly 803. Lower sidewalls 118 and upper sidewalls 121 each have a front mating edge 140. Ram assembly 115 is covered with compartment top cover 128 and ram 119 has compartment rear wall 123 extending upward therefrom when ram 119 is in a retracted position as shown. Ram slide rail 124 longitudinally extends between each lower side wall 118 and upper sidewall 121 wherein an outwardly depending portion of ram 119 slides when ram 119 is longitudinally pushed or pulled to or from rear power head assembly 803 with a separate hydraulic ram system. Hydraulic cylinder 139 is a component part of a hydraulic system for sliding compartment assembly 102 for and aft front compartment frame 101. Front compartment bumper plate 122 is shown centrally depending downward from a rear portion of compartment plate 112 for engagement with rear power head bumper plate 120.

Also shown here are optional ram and compartment wiper assemblies. Rear wiper plate 149 is hingedly attached to compartment rear wall 123 with hinge 189. Wiper 151 wipes an upper surface of ram assembly 115 when ram 119 is moved for and aft compartment plate 112. Compartment cover 128 is modular in sections wherein a rear section can be removed allowing access to wipers 149. Wipers 147 are adjacent an upper rear surface of ram 119 and have an outward force applied thereto wiping an inner surface of lower compartment side wall 118. Wiper 145 extends a lower inner edge of ram 119 and wipes the upper surface of compartment plate 112. Ram 119 can be extended beyond compartment 112 allowing access to pipers 147 and 145.

Figure 9:
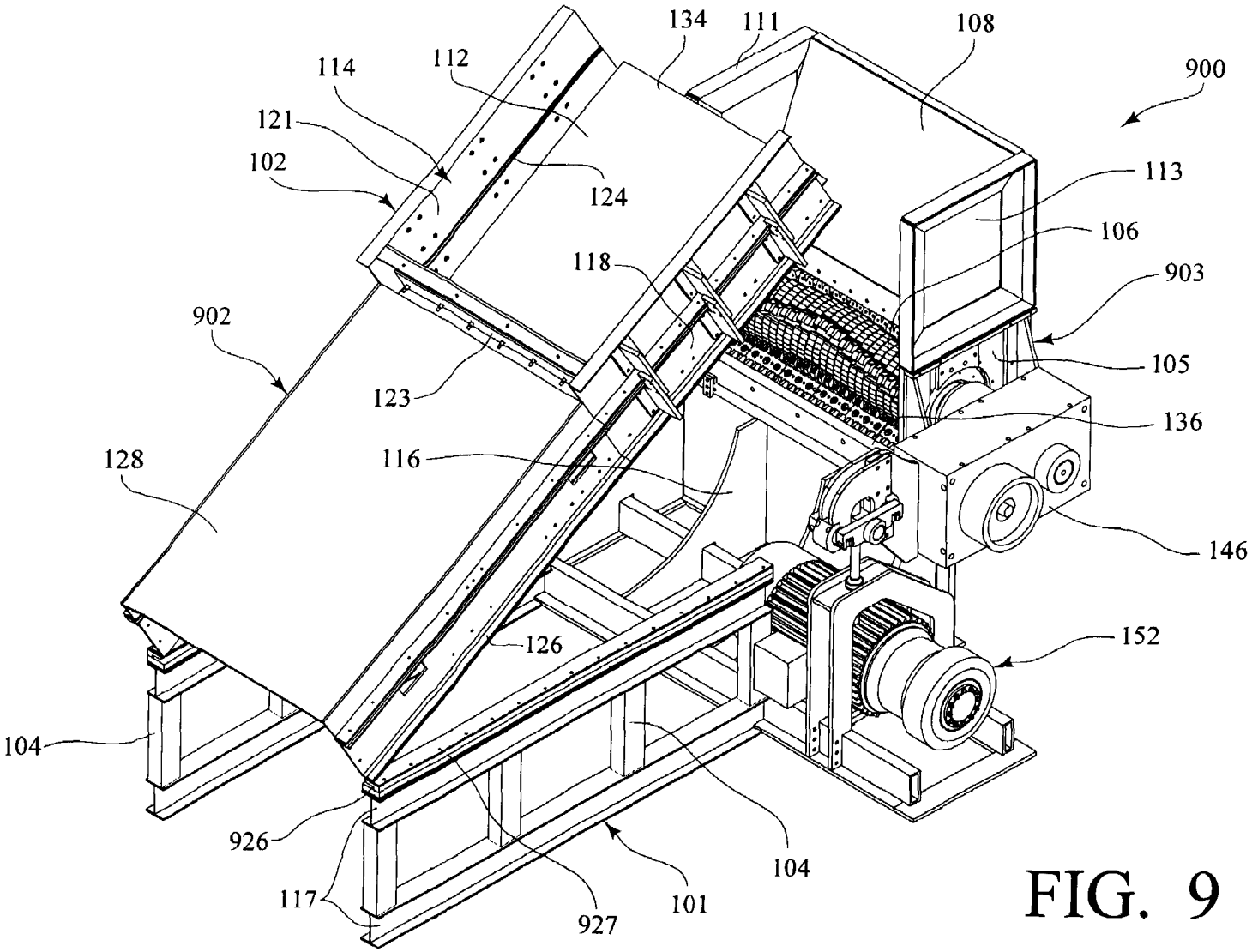
FIG. 9 is a perspective view of an embodiment of the modular grinder having a front hinged compartment assembly.

FIG. 9 shows an alternative embodiment of the modular grinder of the present invention. Modular grinder 900 has front compartment assembly 902 and rear power assembly 903. In this embodiment, front compartment assembly 114 rotates upward wherein front compartment plate lip 134 is raised from anvil 136 and the front lower corners of modular lower compartment sidewalls 118 are hingedly attached with hinges 926 to upper longitudinal supporting beams 117. Upper supporting beams 117 horizontally extend atop compartment supporting legs 104 from front hinge attachments 926 and have front compartment assembly supports 927 thereon to engage outwardly extending flanges 126. The upward rotation of front compartment assembly 902 provides working space between front compartment assembly 902 and power assembly 903 wherein rotor 106, counter knife 109, and other components of rotary grinder 900 can be serviced or replaced without the need to remove materials in front compartment 114 or the need to disassemble rotary grinder 900.

What is claimed is:

1. A modular rotary grinder, comprising:

a rear power head assembly having a power head frame supporting a right lower power head wall, a left lower power head wall, an anvil, a rotor, a gear box, and a motor;

said right lower power head wall and said left lower power head wall each having a rear mating edge, said anvil movably extending between said right and left lower power head walls proximate a portion of said rotor;

a front compartment assembly having a front compartment and a ram assembly, said front compartment defined by a lower compartment plate and an upward extending lower compartment sidewall proximate each longitudinal edge of said lower compartment plate, said compartment plate and said compartment sidewalls being supported with a front compartment frame, said lower compartment sidewalls each having a front mating edge, said ram assembly having a ram with a lower edge proximate said lower compartment plate and side edges proximate each of said lower compartment side walls;

said rear mating edges on said rear power head assembly and said front mating edges on said front compartment assembly being matingly engageable, said anvil and said lower compartment plate being engageable, engagement of said mating edges and said anvil with said lower compartment plate forms a compartment having said rotor in a rear portion thereof and disengagement of said mating edges and said anvil from said lower compartment plate provides for a man access-way between said rear power head assembly and said front compartment assembly; and a retainer assembly having a portion on said front compartment assembly and a portion on said a rear power head assembly, each of said portions of said retainer assembly being cooperable with the other of said portions enabling said front compartment assembly and said rear power head assembly to be securely engaged wherein said front and front mating edges are mated and said anvil is mated with said compartment plate.

2. The modular rotary grinder of claim 1 wherein said portion of said retainer assembly on said front compartment assembly is either a clamp rod sleeve or a clamp rod fastener on an upper portion of each side of said power head frame, said front compartment assembly having the other of said clamp rod sleeve or said clamp rod fastener proximate each rear outer corner of said compartment plate, a clamp rod extending through said clamp rod sleeve into said clamp rod fastener and removably cooperating with said clamp rod fastener retainer.

3. The modular rotary grinder of claim 2 wherein said clamp rod is a threaded bolt and said clamp rod fastener is a nut threadingly engageable with said threaded bolt, said nut being removably retained with said clamp rod fastener.

4. The modular rotary grinder of claim 1 wherein said front compartment assembly has a compartment bumper plate centrally depending from a lower side of said compartment plate, said power head assembly has a power head bumper plate centrally oriented on a front portion of said power head frame, said compartment bumper plate engaging said power head bumper plate when said retainer assembly is securely engaged.

5. The modular rotary grinder of claim 1 wherein said front compartment frame is slidingly engageable with said compartment plate.

6. The modular rotary grinder of claim 5 wherein said slidingly engagement between said compartment plate and said compartment frame comprises a polymeric material on an upper surface of said compartment frame supporting said compartment plate.

7. The modular rotary grinder of claim 1 wherein said compartment plate and said compartment frame are hingedly cooperable at a front edge of said compartment plate and said compartment frame enabling the rear of said compartment plate to swing upwardly providing said working space between said rear power head assembly and said front compartment assembly.

8. The modular rotary grinder of claim 1 wherein said lower compartment plate has a compartment plate lip extending beyond said mating edges of said lower compartment sidewalls positioned to cooperate with a top surface of said anvil when said mating edges are mated.

9. A modular rotary grinder, comprising:

a rear power head assembly having an unitary universal power head frame supporting component parts, said component parts being removable and including a right power head wall, a left power head wall, a lower anvil, a rotor, a gear box, and a motor, said right power head wall and said left power head wall each removably disposed about an axial end of said rotor, said anvil being moveable and extending between said right and left power head walls proximate a front lower portion of said rotor; and a front compartment assembly having a front compartment and a ram assembly supported by a front compartment frame, said front compartment defined by component parts including a lower compartment plate and an upward extending lower sidewall proximate each longitudinal edge of said lower compartment plate;

one of said rear power head assembly and said front compartment being movable from a first position engaged with the other of said rear power head assembly and said front compartment to a second position spaced from the other of said rear power assembly and said front compartment and defining a man access-way therebetween.

10. The modular rotary grinder of claim 9 wherein said rear power head assembly and said front compartment assembly are removably retained together with a retainer assembly, said retainer assembly having a portion on said front compartment assembly comprising either a clamp rod sleeve or a clamp rod fastener on an upper portion of each side of said power head frame, said front compartment assembly having the other of said clamp rod sleeve or said clamp rod fastener proximate each rear outer corner of said compartment plate.

11. The modular rotary grinder of claim 10 wherein said clamp rod is a threaded bolt and said clamp rod fastener is a nut threadingly engageable with said threaded bolt, said nut being removably retained with said clamp rod fastener.

12. The modular rotary grinder of claim 10 wherein said front compartment assembly has a compartment bumper plate centrally depending from a lower side of said compartment plate, said power head assembly has a power head bumper plate centrally oriented on a front portion of said power head frame, said compartment bumper plate engaging said power head bumper plate when said retainer assembly is securely engaged.

13. The modular rotary grinder of claim 9 wherein said front compartment assembly is slidingly engageable with said rear power head assembly.

14. The modular rotary grinder of claim 13 wherein an upper surface of said compartment frame supporting said compartment plate has a polymeric material thereon.

15. The modular rotary grinder of claim 9 wherein said compartment plate and said compartment frame are hingedly cooperable at a front edge of said compartment plate and said compartment frame enabling the rear of said compartment plate to swing upwardly providing a working space between said rear power head assembly and said front compartment assembly.

16. The modular rotary grinder of claim 9 wherein said lower compartment plate has a compartment plate lip extending beyond mating edges of said lower compartment sidewalls positioned to cooperate with a top surface of said anvil.

17. A split apart modular rotary grinder having a power head assembly and a compartment assembly;

said power head assembly comprised of component parts of a power head frame, lower and upper sidewalls, a rear wall, a cylindrical rotor axial supported on said power head frame between said lower and upper sidewalls, an anvil extending between said lower sidewalls, and a counter knife longitudinally extending along said anvil and removably supported thereon;

said compartment head assembly comprised of component parts of a front compartment and a ran assembly supported by a front compartment frame, said front compartment defined by component parts including a lower compartment plate and an upward extending lower sidewall proximate each longitudinal edge of said lower compartment plate; and said power head assembly and said compartment assembly having a first engaged position and a second split apart position, said split apart position having a man access-way between said power head assembly and said compartment assembly allowing man entry therebetween.

18. The modular rotary grinder of claim 17 wherein said front compartment frame is slidingly engageable with said compartment plate, sliding said compartment plate forward on said front compartment frame provides said space between said front compartment frame and said rear power head assembly.

19. The modular rotary grinder of claim 17 wherein said compartment plate and said compartment frame are hingedly cooperable at a front edge of said compartment plate and said compartment frame enabling the rear of said compartment plate to swing upwardly providing said space between said front compartment frame and said rear power head assembly.

20. The modular rotary grinder of claim 17 wherein said front compartment assembly and said rear power head assembly have at least three areas of engagement therebetween when in said first engaged position, said at least three areas of engagement comprising a lower front and rear bumper plate, a centrally oriented retainer assembly, and mating edges of said side walls of said front compartment assembly and said rear power head assembly.

* * * * *